United States Patent [19]

Park

[11] 4,337,879

[45] Jul. 6, 1982

[54] SQUEEZING DEVICE

[76] Inventor: Rodney W. Park, Dana Hohenort Ave., Constantia, Cape Province, South Africa

[21] Appl. No.: 159,418

[22] Filed: Jun. 16, 1980

[51] Int. Cl.[3] ..... B65D 35/28

[52] U.S. Cl. ..... 222/102

[58] Field of Search ..... 222/101, 102

[56] References Cited

U.S. PATENT DOCUMENTS 3,313,454 4/1967 Welsh et al. ..... 222/102

3,501,054 3/1970 Maurice ..... 222/102

*Primary Examiner*—Robert J. Spar

*Assistant Examiner*—Edward M. Wacyra

*Attorney, Agent, or Firm*—Ladas & Parry

[57] ABSTRACT

A device for squeezing tubes, such as toothpaste tubes having two parallel rollers between which the tube is inserted. One of the rollers is rotated so that the rollers, which are mounted in a slide, move along the length of the tube towards its neck. When sufficient of the tube contents has been dispensed, the rotation is stopped. An arrangement is provided to ensure that the rollers do not move back along the length of the tube after each dispensing step.

6 Claims, 5 Drawing Figures

SQUEEZING DEVICE

BACKGROUND TO THE INVENTION

This invention relates to a squeezing device and is particularly concerned with a device for squeezing deformable tubes having a neck and containing material to be dispensed.

A frequently encountered problem with such tubes, e.g. toothpaste tubes, is that they are squeezed in such a fashion that only a portion of the contents are dispensed, the remainder being thrown away with a mangled tube. This invention seeks to overcome this problem.

SUMMARY OF THE INVENTION

According to the invention there is provided a device for squeezing deformable tubes having a neck and containing a material to be dispensed, the device including a housing, a slide movable along a path in the housing, a first roller mounted on the slide about an axis perpendicular to the direction of movement of the slide, a second roller mounted on the slide about an axis parallel to the axis of the first roller, the rollers being arranged so that a tube can be inserted between them, means for ensuring that the rollers progress in one direction only along a tube inserted between the rollers, means for rotating the second roller, and means for holding the neck of a tube relatively to the housing.

The progressing means comprises a substantially flat face formed on the second roller and means biassing the slide in a direction towards the neck of a tube located within the housing, so that on rotating the second roller in a first direction the roller progresses along and squeezes the tube between itself and the other roller, while on rotation in the opposite, second direction the flat face is presented towards the first roller with the tube being a free fit between the rollers, so that the slide and rollers can progress along the tube. The weight of the slide will normally be sufficient to move the slide, under the influence of gravity, towards the neck of the tube. Conveniently means is provided to bias the second roller to the second position in which the flat face is presented to the first roller.

Preferably means is provided for resiliently biassing the first and second rollers towards each other. In one form the means may be spring means biassing one or both of the rollers towards each other. In another form one or both of the rollers may be made of a resilient material, such as hard rubber.

Further features and advantages of the invention will become apparent from the following description made with reference to the attached schematic drawings.

DESCRIPTION OF PREFERRED EMBODIMENTS

Figure 1:
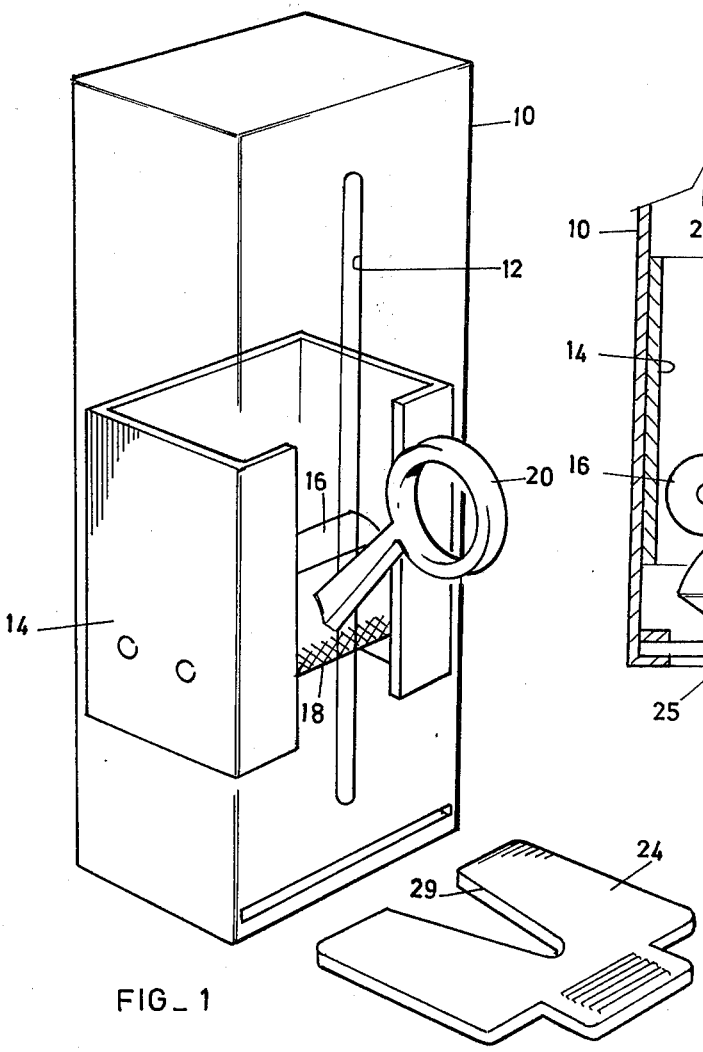
FIG. 1 is a perspective view of a preferred embodiment of the invention.
Figure 2:
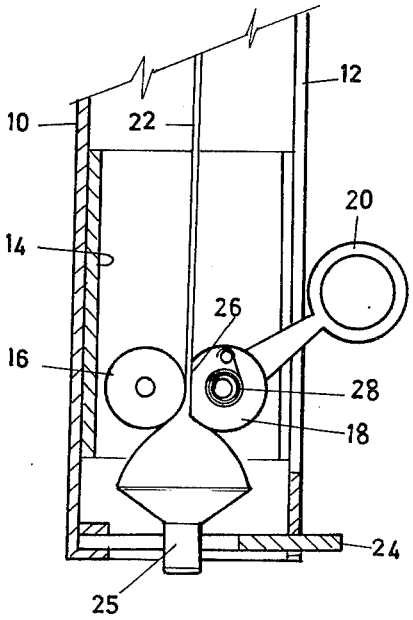
FIG. 2 is a partly sectioned side view of the device of FIG. 1.

Firstly referring to FIGS. 1 and 2 of the drawings there is shown a squeezing device of the invention including a rectangular housing 10 formed with a longitudinal slot 12, a slide 14 movably guided in the housing, a first roller 16 mounted on the slide, a second roller 18 also mounted on the slide about an axis parallel to and spaced from the axis of the first roller, a handle 20 secured to the second roller, a toothpaste tube 22 in the housing, and a removable closure and clamping plate 24 slidably engageable with the housing 10 and adapted to grip the neck 25 of the tube 22.

As shown in FIG. 2 the roller 18 has a flat face 26 and is biassed by a coiled flat spring 28 to a position in which the flat face is presented towards the first roller 16.

In use the device operates as follows.

Firstly a tube 22 is loaded into the device 10 by removing the closure 24, inserting the rear end of the tube into the gap between the flat face 26 of the second roller and the roller 16, pushing the tube and slide which is now engaged with it upwardly until only the neck 25 of the tube projects from the base of the housing 10, and then replacing the closure 24 into the housing so that the neck 25 fits in to a tapered slot 29 in the closure 24 and is engaged by the walls of the slot. To dispense toothpaste or the like, the cap, not shown, of the tube is removed and the handle 20 pulled downwardly. This causes the roller to move from the position where its flat face 26 is in contact with the tube to a position where its cylindrical face is in contact whereby the roller 18 progresses along and squeezes the tube to eject a desired quantum of its contents. When sufficient of its contents has been dispensed, the handle is released so that it returns to its position shown in FIG. 2 under the action of the bias of the spring 28. When it has returned to the position shown in FIG. 2 the tube and roller can slide relatively to each other so that under the action of gravity the slide as a whole moves down along the tube. The device is now ready for dispensing again.

Figure 3:
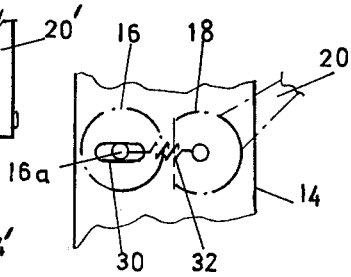
FIG. 3 shows a part of a second embodiment of the invention.

FIG. 3 shows a modification of the device of FIGS. 1 and 2, wherein the journals **16*a* at the ends of the roller 16 are each guided in a slot 30 formed in the slide 14 and the journals are connected by a pair of coil springs 32 to the roller 18 to bias the roller 16 towards the roller 18**. This construction is to cater for tubes of differing thicknesses.

Figure 4:
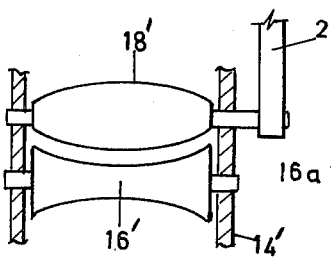
FIG. 4 shows a part of a different squeezing device.

FIG. 4 shows another modification of the device, wherein the roller 18' is convex and the roller 16' is concave. This construction is to reduce the thickness of the device which arises from the overlap of the rollers 16' and 18'. Also shown schematically in this drawing is the construction wherein the handle 20' is located laterally outside the slide 14'; in this event the slot 12' in the housing would be formed in the side of the housing rather than in the front of the housing as shown in FIGS. 1 and 2.

Figure 5:
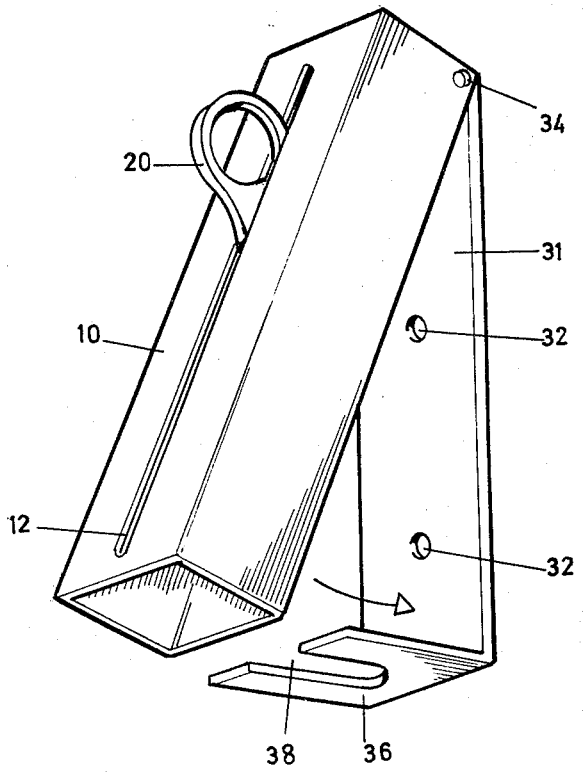
FIG. 5 is a perspective view of a further feature of the invention.

FIG. 5 shows an embodiment of the device which is adapted to be mounted on a wall. A back plate 31 has holes 32 for receiving screws which hold the back plate against a wall. The housing 10 is pivoted to this back plate at 34. The housing contains the same components as shown in preceding figures. At the bottom of the back plate 31, a tube retaining plate 36 projects outwards. This plate 36 has a slot 38 in which a toothpaste tube neck is received. In use, the housing 10 is swung into the position shown in the figure and a toothpaste tube is pushed up inside. When just the neck of the tube protrudes out from the bottom of the housing, the housing is swung back against the back plate 31 so that the tube neck is received in slot 38. The device is then ready for use.

As will be apparent to persons skilled in the art many modifications may be made to the invention. For example the roller 18 can be made to be rotatable in one direction only by the use of a suitable pawl and ratchet arrangement. For instance a ratchet can be fixed to a side of the roller 18 and a pawl can be fixed to the handle 20 so that when the handle moves in one direction the pawl engages in the ratchet and rotates the roller 18, while when the handle is moved in the opposite direction there is no engagement of the pawl and ratchet. Also the end closure 24 may be modified and may take many different forms for achieving any function of locking the neck of the tube to the housing.

I claim:

1. A device for squeezing deformable tubes which have a neck and contain a material to be dispensed, the device comprising a housing, means for holding the neck of a tube relative to the housing, a slide in the housing, the housing defining a path of movement for the slide, a first roller mounted on the slide and having an axis which is perpendicular to the path of movement of the slide, a second roller mounted on the slide about an axis parallel to the axis of the first roller and having a flat face formed thereon, the first and second rollers being arranged so that a tube can be inserted between them, means for ensuring that the rollers progress in one direction only along a tube inserted between the rollers, means for rotating the second roller, the slide being movable in a direction towards the neck of a tube in the housing so that on rotating the second roller in the first direction, the roller progresses along and squeezes the tube between itself and the first roller, while on rotation in the opposite, second direction the flat face is presented towards the first roller with the tube being a loose fit between the rollers and the slide so that the slide can move towards the neck of the tube.

2. A device as claimed in claim 1, wherein the second roller is biassed to a position in which the flat face is presented to the first roller.

3. A device as claimed in claim 1, wherein the first and second rollers are biassed towards each other.

4. A device as claimed in claim 1, wherein at least one of the rollers is made of a resilient material.

5. A device as claimed in claim 1, wherein the means for rotating the second roller is a manually operable handle.

6. A device as claimed in claim 1, including a back plate to be fixed to a wall, the housing being pivoted to the back plate, and the means for holding the neck of a tube being integral with the back plate.

* * * * *